US007172138B2

(12) United States Patent
Mather et al.

(10) Patent No.: US 7,172,138 B2
(45) Date of Patent: Feb. 6, 2007

(54) POWDER SPRAY GUN MOUNT AND CLEANING ARRANGEMENTS

(75) Inventors: Brian D. Mather, North Olmsted, OH (US); Edward L. Jones, Strongsville, OH (US); Jeffrey R. Shutic, Wakeman, OH (US)

(73) Assignee: Nordson Corporation, Westlake, OH (US)

( * ) Notice: Subject to any disclaimer, the term of this patent is extended or adjusted under 35 U.S.C. 154(b) by 132 days.

(21) Appl. No.: 10/470,453

(22) PCT Filed: Jan. 30, 2002

(86) PCT No.: PCT/US02/02581

§ 371 (c)(1),
(2), (4) Date: Jul. 25, 2003

(87) PCT Pub. No.: WO02/060595

PCT Pub. Date: Aug. 8, 2002

(65) Prior Publication Data

US 2004/0065752 A1 Apr. 8, 2004

Related U.S. Application Data

(60) Provisional application No. 60/327,667, filed on Oct. 5, 2001, provisional application No. 60/265,834, filed on Jan. 31, 2001.

(51) Int. Cl.

| | |
|---|---|
| ***B05B 15/02*** | (2006.01) |
| ***B05B 1/28*** | (2006.01) |
| ***B05B 15/06*** | (2006.01) |
| ***B05B 15/08*** | (2006.01) |

(52) U.S. Cl. ..... 239/106; 239/104; 239/120; 239/280.5; 239/283; 239/DIG. 21; 248/75; 248/80; 248/297.21; 248/297.31

(58) Field of Classification Search ..... 239/273, 239/693, 104, 105, 106, 290, 292, DIG. 21, 239/120, 121, 750–752, 207–210, 280, 280.5, 239/282, 283, 261, 264, 265; 248/80, 82, 248/84, 86, 88, 225.11, 297.21, 297.31, 81; 134/198; 118/302, 308, 309

See application file for complete search history.

(56) References Cited

U.S. PATENT DOCUMENTS 2,088,542 A * 7/1937 Westin ..... 427/233

(Continued)

FOREIGN PATENT DOCUMENTS

DE 3013777 A 2/1982

(Continued)

OTHER PUBLICATIONS

International Search Report for PCT/US02/02581.

*Primary Examiner*—Kevin Shaver
*Assistant Examiner*—Darren Gorman
(74) *Attorney, Agent, or Firm*—Calfee, Halter & Griswold LLP

(57) ABSTRACT

A gun mount for a spray gun includes a rigid bracket that is installed on a rigid vertical support such as a gun mover. The bracket securely mounts the guns so as to reduce vibration and swaying during a spraying operation, even when the guns are being vertically moved by an oscillator. A position label or other suitable indicia is provided on the bracket so that the gun mount position can be recorded and thereby accurately repeated during subsequent installations. The bracket in one embodiment includes a series of vertical and horizontal mounting holes that permit a gun body to be installed at a desired vertical and horizontal orientation. A gun blow off arrangement is also provided for mounting associated pairs of air nozzles in position to blow powder from gun exterior surfaces. The associated pairs of air nozzles are mounted on a common bracket that can be selectively and slideably positioned on a channel support. An air nozzle positioning indicating device is provided to accurate position and record the position of the air nozzles for particular gun positions.

14 Claims, 11 Drawing Sheets

U.S. PATENT DOCUMENTS

| | | | | | |
|---|---|---|---|---|---|
| 3,274,860 | A | | 9/1966 | Gauthier et al. | |
| 3,685,824 | A | * | 8/1972 | Quinn | 482/17 |
| 3,869,798 | A | * | 3/1975 | Wilkerson | 33/264 |
| 3,876,144 | A | * | 4/1975 | Madden et al. | 239/106 |
| 4,412,679 | A | * | 11/1983 | Mahoney et al. | 473/483 |
| 4,616,782 | A | | 10/1986 | Marietta et al. | |
| 4,842,195 | A | * | 6/1989 | Koll et al. | 239/1 |
| 5,094,398 | A | | 3/1992 | Jeter et al. | |
| 5,265,800 | A | | 11/1993 | Ziecker et al. | |
| 5,296,035 | A | | 3/1994 | Chicatelli et al. | |
| 5,405,087 | A | * | 4/1995 | Waryu et al. | 239/288 |
| 5,612,096 | A | | 3/1997 | Mulder et al. | |
| 5,683,037 | A | | 11/1997 | Rochman et al. | |
| 5,759,271 | A | * | 6/1998 | Buschor | 118/308 |
| 5,800,615 | A | | 9/1998 | Lambert et al. | |
| 5,941,463 | A | | 8/1999 | Herstek et al. | |
| 5,957,396 | A | | 9/1999 | Crum et al. | |
| 6,302,122 | B1 | * | 10/2001 | Parker et al. | 132/333 |
| 6,519,868 | B1 | * | 2/2003 | Pryor et al. | 33/832 |

FOREIGN PATENT DOCUMENTS

| | | |
|---|---|---|
| EP | 0779 107 A | 6/1997 |
| WO | WO 96 03219 | 2/1996 |

* cited by examiner

POWDER SPRAY GUN MOUNT AND CLEANING ARRANGEMENTS

RELATED APPLICATIONS

This application claims the benefit of U.S. Provisional patent application Ser. No. 60/265,834 filed on Jan. 31, 2001 for AUTOMATIC POWDER GUN MOUNTING SYSTEM WITH INTEGRAL SET-UP SCALE and U.S. Provisional patent application Ser. No. 60/327,667 filed on Oct. 5, 2001 for EXTERNAL GUN BLOW OFF ASSEMBLY, the entire disclosures of which are fully incorporated herein by reference.

TECHNICAL FIELD OF THE INVENTION

The present invention relates to controlling position and movement of a powder spray gun for powder spraying and gun cleaning operations. More particularly, the invention relates to a mounting arrangement for a spray gun that provides repeatable positioning and stability of the gun during a spraying operation and a cleaning operation such as may occur during a color change procedure. The invention is also directed to a spray gun blow off apparatus that uses an adjustable and repeatable air nozzle positioning arrangement.

BACKGROUND OF THE INVENTION

Powder spraying systems are well known. A typical powder spraying system includes a powder source, such as powder stored in a fluidizing hopper. The powder in the hopper may be fluidized using pressurized air, although not all powder spray systems use fluidized powder supplies. The spraying system also includes a powder spray device such as a spray gun that extends into a spray booth. The spray gun is used to spray powder at an object inside the booth. The spray booth is used for powder containment and recovery. Many types of spray guns have been developed over the years including electrostatic guns such as corona spray guns and tribo-charging guns. Most powder spraying systems also include a powder collection system to collect powder overspray. Some powder spraying systems use non-electrostatic spray guns.

In many powder spray systems, it is desirable to be able to move a spray gun or a plurality of spray guns automatically toward and away from the object being sprayed. For example, a gun mover that is positioned outside the spray booth may be used to position spray guns into and retract spray guns from a spray booth through suitable openings in the spray booth wall structure. Known gun movers, including gun movers such as are described in U.S. Pat. No. 4,616,782 and in co-pending U.S. patent application Ser. No. 09/589,946 for PNEUMATICALLY CONTROLLED SPRAY GUN MOVER, both of which disclosures are fully incorporated herein by reference, include the capability of horizontal positioning as well as vertical positioning of one or more guns mounted on, the gun mover. Vertical movement of the guns during a spraying operation is also commonly effected by an oscillator device.

Spray guns are typically mounted on known gun movers via a series of vertical and horizontal gun mount bars or tubes. The spray gun bodies are secured to the horizontal bars by bracket assemblies that can be slipped onto the bars and tightened. One drawback of such known gun mounts is that the initial mounting position of the gun is not easily or reliably repeatable. The various mounting bars also tend to flex and bend during a spraying operation, especially when the guns are being vertically moved by the oscillator. In some spray systems, the gun bodies can be quite long, thereby compounding any vibration and flexing of the gun mount arrangement.

Powder spray guns, especially electrostatic spray guns, tend to collect powder overspray on their exterior gun surfaces. This powder must be removed if the powder color is to be changed. A complete color change procedure can be slowed down by having a large number of surfaces inside the spray booth and on the gun bodies to be cleaned. Known powder spraying systems include air nozzles positioned near a spray gun to blow powder off the gun body. This can be accomplished, for example, as the guns are retracted from the booth by the gun mover. However, known systems are limited in that the air nozzles are fixed in position or otherwise not easily adjusted, and cannot be repeatedly-positioned at a predetermined location relative to the gun position. Gun positions may be changed, for example, depending on the object being sprayed.

With reference to FIGS. 1 and 2, a typical prior art powder spraying system 10 is illustrated with a prior art gun bar mounting configuration. The illustrations of FIGS. 1–2 are simplified in order to explain a typical application to which the present invention may be applied. The system 10 gun mount components illustrated in FIGS. 1–2 are well known.

The spray system 10 typically includes a spray booth 12 that partially encloses an object A being sprayed. The spray booth 12 may include a powder-collection system 14 to recover powder overspray. A powder feed hopper 16 holds a supply of spray powder that is fed to one or more spray guns 18 via powder feed lines 20. The spray guns 18 spray the object A non-electrostatically or with an electrostatically charged powder spray 22.

Known systems 10 often incorporate the use of a gun mover 30. The gun mover 30 includes a base 32 that supports a movable platform 34. A gun support 36 is vertically mounted on the movable platform 34. In the prior art, the gun support 36 is a fixed gun support that includes a number of horizontal support arms 37 that are mounted to a fixed stand 40. A number of vertical mounting bars 39 are attached to, the horizontal support arms 37. Horizontal gun mount bars 38 to which the spray guns 18 are removably attached as by any conventional clamp assembly, for example, may also be used. The spray guns 18 may also be mounted directly to the vertical bars 39. The fixed stand 40 is generally vertically oriented and securely mounted on the movable platform 34. By "fixed" is simply meant that the guns 18 are moved only by the mover 30, in a single direction parallel with the translation axis of the platform 34 as denoted by the directional arrow B in FIG. 1. The stand 40 may also be a gun oscillator, as is known in the art. Such an oscillator imparts vertical position control and movement to the guns attached to the oscillator, thus allowing vertical and horizontal position control of the guns 18.

The gun mover 30 further includes a control system 42 for programmable control of the position of the guns 18. The control system 42 includes a control device 44. The control device 44 may be used to control position of the guns in the spray booth, operation of the oscillator, and operation of the spray guns.

The present invention is directed to a repeatable and stable spray gun mounting arrangement, an adjustable and repeatable gun blow off arrangement, and a powder spraying apparatus that can utilize the gun mounting and blow off arrangements to facilitate quicker color change operations.

SUMMARY OF THE INVENTION

In accordance with an embodiment of the invention, a gun mount for a spray gun includes a rigid integral bracket that is installed on a rigid vertical gun support, such as, for example, a gun mover, a fixed support or an oscillator. The bracket securely mounts the guns so as to reduce vibration and swaying during a spraying operation, even when the guns are being vertically moved by an oscillator. A position indicating device such as, for example, a label or other suitable indicia is associated with or provided on the bracket so that each mounted gun position can be noted and recorded if so desired and thereby reliably repeated during subsequent installations. The mounting bracket in one embodiment includes a series of vertical and horizontal mounting holes that permit a gun body to be installed at a desired vertical and horizontal orientation.

The mounting bracket is in one embodiment a truss-like frame that supports a plurality of guns thereon. The bracket may be mounted in a laterally offset position relative to the gun support such as a gun mover so as to provide easy access to the back ends of the spray guns without interference from the gun support or mover.

In accordance with another aspect of the invention, a powder blow off cleaning arrangement is provided for removing powder from external surfaces of the spray gun bodies. In one embodiment, associated pairs of air nozzles are installed on a mounting bracket that can be slideably adjusted in position relative to a spray gun position. In accordance with another aspect of the invention, an air nozzle position indicating device is provided for repeatable and reliable positioning of the air nozzles relative to a spray gun position. The position indicating device may be, for example, a label or other device having indicia corresponding to selectable positions.

In accordance with another aspect of the invention, a powder spray apparatus is provided that facilitates a quick color change procedure by being able to reliably and repeatedly position spray guns and air nozzles for cleaning the spray guns. In one embodiment the powder spray apparatus incorporates one or both of the above gun mounting and cleaning arrangements.

These and other aspects and advantages of the present invention will be apparent to those skilled in the art from the following description of the preferred embodiments in view of the accompanying drawings.

BRIEF DESCRIPTION OF THE DRAWINGS

The invention may take physical form in certain parts and arrangements of parts, preferred embodiments and a method of which will be described in detail in this specification and illustrated in the accompanying drawings which form a part hereof, and wherein.

DETAILED DESCRIPTION OF THE INVENTION

The present invention is directed to improving a mounting arrangement of a plurality of powder spray guns to a gun support such as a gun mover for example, the invention is also directed to improving the repeatability and vertical position resolution of the spray guns. Still further, the present invention is directed to improving gun blow off arrangements for removing powder overspray from exterior surfaces of the spray guns. The gun mounting and blow off arrangements of the present invention may be used together to improve color change operations, however, each may be used without the other as required for a particular application. Various aspects and embodiments of the present invention are illustrated and described herein as being used together, however, such description should not be construed in a limiting sense. Those skilled in the art will readily appreciate that various aspects of the invention may be used alone or in a number of different combinations and subcombinations thereof within the spirit and scope of the present invention. Furthermore, although various preferred and alternative embodiments of the invention are described herein, such descriptions are not intended to be an exhaustive list of such alternatives and options. Additional alternatives and modifications will be readily apparent to those skilled in the art within the spirit and scope of the present invention.

While the present invention is described in terms of being incorporated into or used with specific elements of a powder spraying apparatus, the present invention is not limited to such descriptions or uses. For example, the invention may be used with different gun supports or gun movers including oscillating and non-oscillating. The present invention is also not limited to any particular spray gun or spray booth configuration or design or spraying technology. For example, the present invention may be used with electrostatic and non-electrostatic spraying techniques and need not be used exclusively with powder spraying apparatus.

Figure 3:
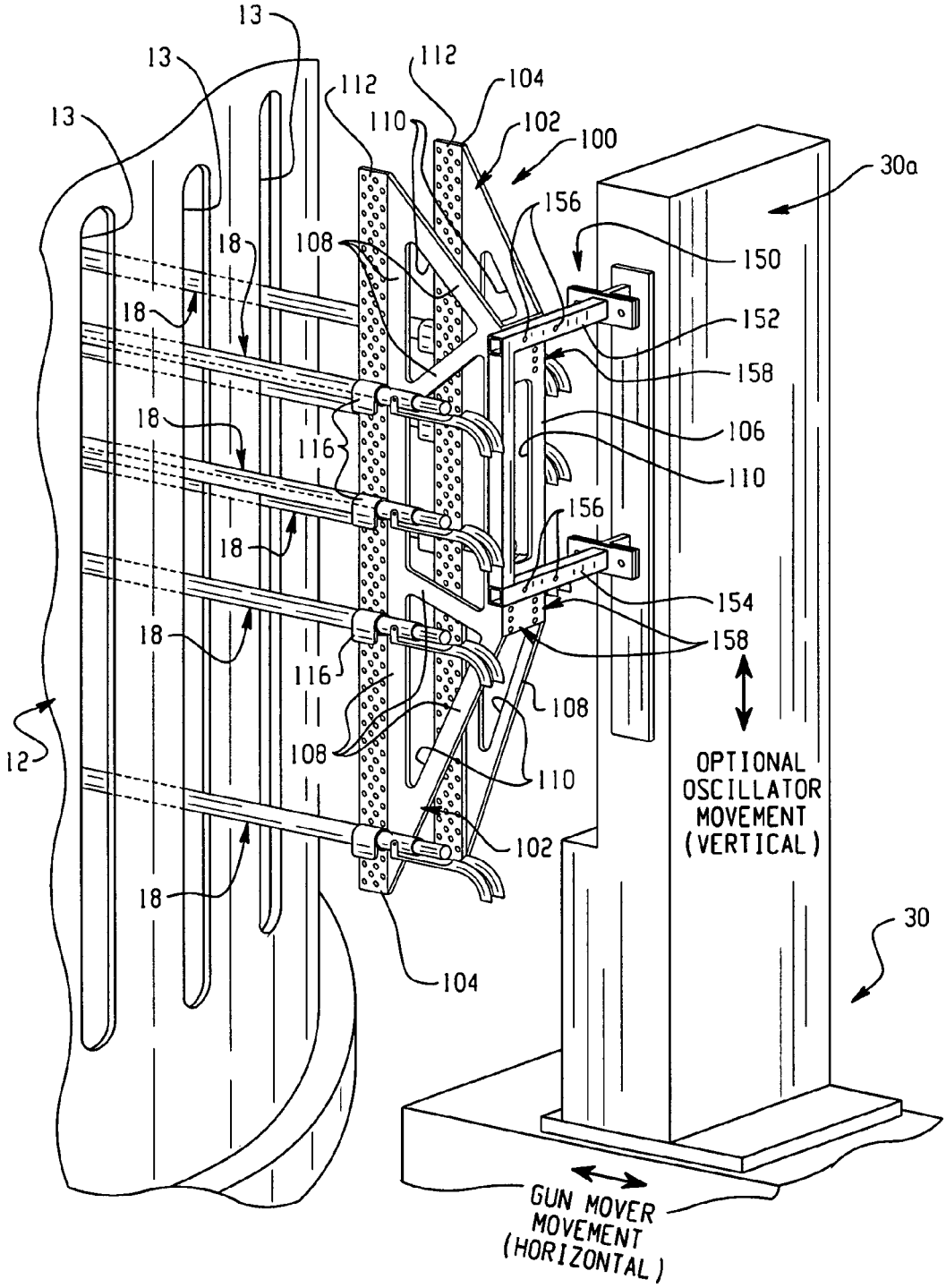
FIG. 3 is a perspective illustration of a mounting bracket in accordance with the invention, with the bracket installed in an exemplary powder spray apparatus.
Figure 4:
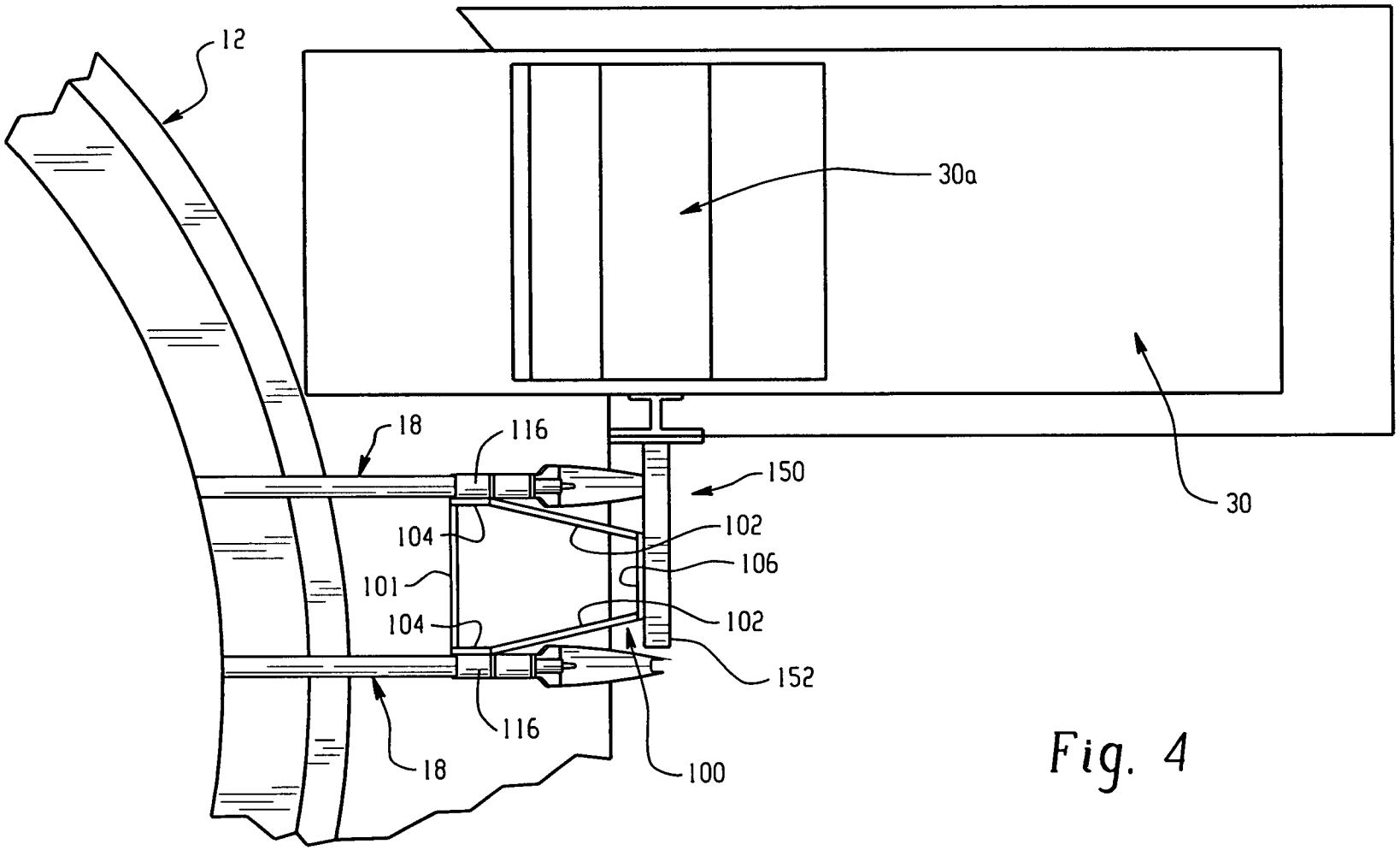
FIG. 4 illustrates a top view of a portion of the apparatus illustrated in FIG. 3.

With reference to FIGS. 3 and 4 then, and in accordance with one aspect of the invention, a gun mounting arrangement is contemplated that significantly increases the stability and repeatability and vertical position resolution of the spray guns mounted thereon. A mounting bracket 100 is provided that in this embodiment is realized in the form of a support or truss-like body 102 having at a front end thereof two generally vertically parallel gun mounting flange portions 104. At the back end of the mounting bracket 100 is a gun support or gun mounting back plate portion 106. The two flange portions 104 and the back plate 106 are rigidly connected together by a pair of truss-like frame arrangement of support arms 108. The two front gun mounting flanges 104, the back plate 106, and the two truss portions 108 are preferably formed as an integral rigid structure by welding or other suitable technique for securing these parts together. Guns may be mounted on either or both sides of the bracket 100.

In the illustrated embodiment of FIG. 3, the bracket 100 is made substantially from sheet metal, however, the bracket 100 can alternatively be made from interconnected tubes or solid rods, to name just two of many examples. In the embodiment of FIGS. 3 and 4, the interconnecting truss-like portions 102 are generally flat webs of sheet metal. By comparison, in the embodiment of FIGS. 5 and 7, the truss-like portions 108 are realized from tubular stock.

FIG. 3 illustrates a typical use of the mounting bracket 100 in a powder spray system. In this example, a plurality of spray guns 18 are supported on a gun support such as a gun mover 30. The gun mover 30 in this example includes an oscillator 30*a* although in general the gun mover 30 need only provide a secure gun support for the spray guns 18. The gun mover 30 may be used to move the guns 18 horizontally into and out of the spray booth 12 through a series of vertically extending gun slots 13. In this example, the spray booth 12 is generally round, however, any suitable spray booth configuration or geometry may be used as required. Operation of the gun mover 30 may be automated as is known. The present invention may alternatively be used with a stationary or other suitable gun support other than a gun mover.

A gun support frame 150 is provided and is installed on the gun mover 30 or other suitable structure as required. The frame 150 is adapted to have the back mounting plate 106 of the bracket 100 securely mounted thereon. For example, the support frame 150 may be realized in the form of upper and lower tubular stock 152, 154 having holes 156 to accept mounting bolts (not shown). The back mounting plate 106 is provided with a series or array of vertically extending mounting holes 158 that correspond with the support frame holes 156. Thus, the vertical mounting position of the mounting bracket 100 may be adjusted on the support frame 150 as required.

The overall weight of the mounting bracket 100 is preferably minimized especially for use with a gun mover. This may be achieved by providing suitable cutouts 110 that reduce the overall mass of the material used to form the truss portions 102 and the back plate 106 without compromising the rigidity and strength of the mounting bracket 100.

Each truss 102 is securely attached to the back plate 106. The trusses 102 extend away from the back plate 106 preferably but not necessarily with an outward flare or taper (see FIG. 4). The forward ends of the trusses 102 are attached respectively each to one of the vertically extending gun mounting flanges 104. The tapered truss portions 102 thus provide a clearance area between the trusses 102 and the back ends of the guns 18 to simplify access to various hoses and other connections (not shown) to the guns 18.

Note especially from FIG. 3 that the mounting bracket 100 is supported in a position that is laterally offset from the gun mover 30. This permits easier access to the guns 18 and associated connections thereto without interference of the gun mover 30. Although not illustrated in FIG. 3, the bracket 100 may include horizontal truss bracing members 101, for example, at the top, bottom and middle portions between the mounting flanges 104 (see FIG. 4).

Figure 6:
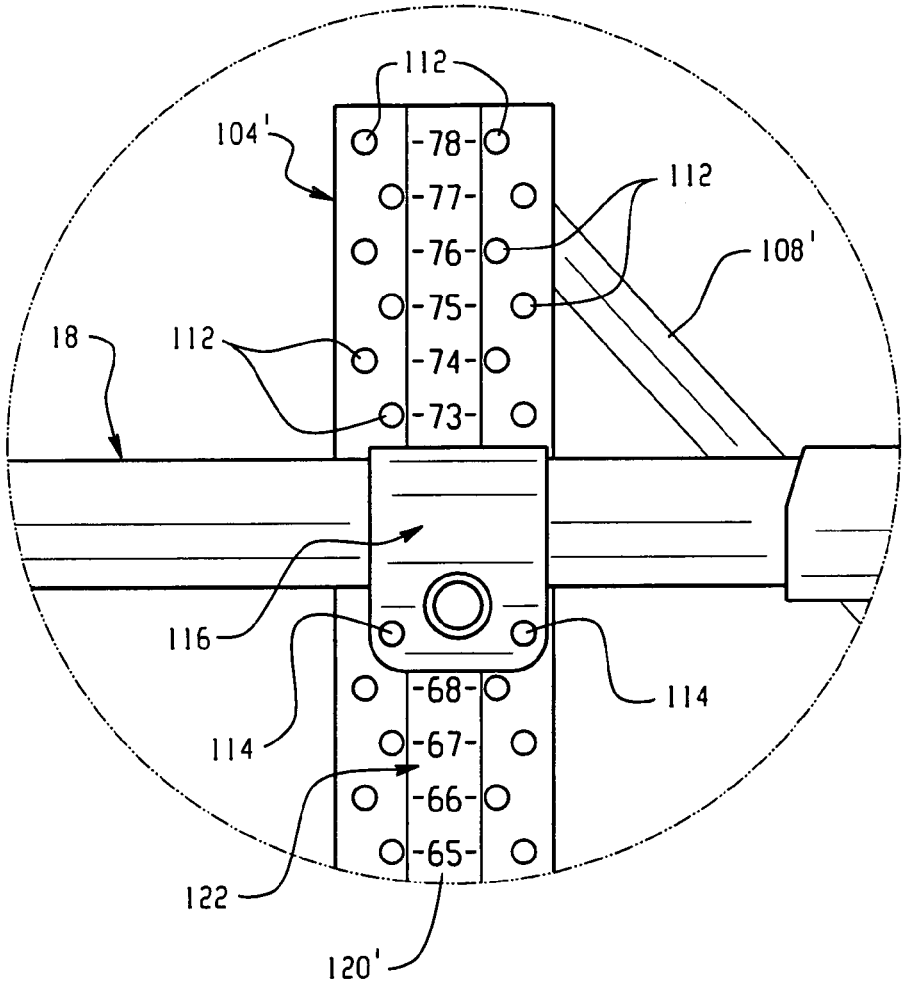
FIG. 6 is an enlarged view of the circled portion of FIG. 5 of a gun position indicating device in accordance with the invention.

With reference to FIG. 6, each of the gun mounting flanges 104 is provided with a vertically extending series of mounting holes 112, that may, for example, be provided along substantially the entire length of the flange 104 or whatever portion of the flanges 104 will be used to mount guns thereon. These holes 112 receive mounting bolts 114 of a gun body mounting clamp 116 that is used to install a gun body 18 on a respective mounting flange 104. The clamp 116 may be, for example, a simple two piece clamping device that rigidly supports the gun body 18 when the clamp 116 is installed on the mounting flange 104.

The overall rigidity of the bracket 100, and the clamping arrangement 116 for the gun body 18, provides a very stable and rigid support even for long gun bodies and particularly even when the guns 18 are being vertically oscillated during a spraying operation.

In accordance with another aspect of the invention, the mounting bracket 100 provides a position indicating device 120 for repeatable mounting position of the guns 18. In the embodiment of FIG. 6, the position indicating device 120 is realized in the form of an adhesive label or other suitable marking on each mounting flange 104. The label 120 includes indicia 122 with a unique reference character for each of the mounting hole 112 positions. In the exemplary embodiment these indicia correspond to height in inches of the associated mounting holes 112. Other indicia may be used and need not necessarily correspond to a particular parameter such as height, but rather may be as simple as indicating which mounting holes 112 were used. The gun positions may be recorded or stored so that after the guns have been replaced or moved or re-installed, if so desired they can be positioned back to their original mounting configuration. This is useful when particular gun mounting configurations are desired for spraying specific objects for example. By using an appropriate number of mounting holes 112, any desired vertical mounting resolution for the spray guns 18 may be realized with high repeatability of the gun mounting positions used for each spraying operation. Gun mounting positions on the flanges 104 can be easily changed and recorded by selecting an appropriate set of holes 112.

Figure 1:
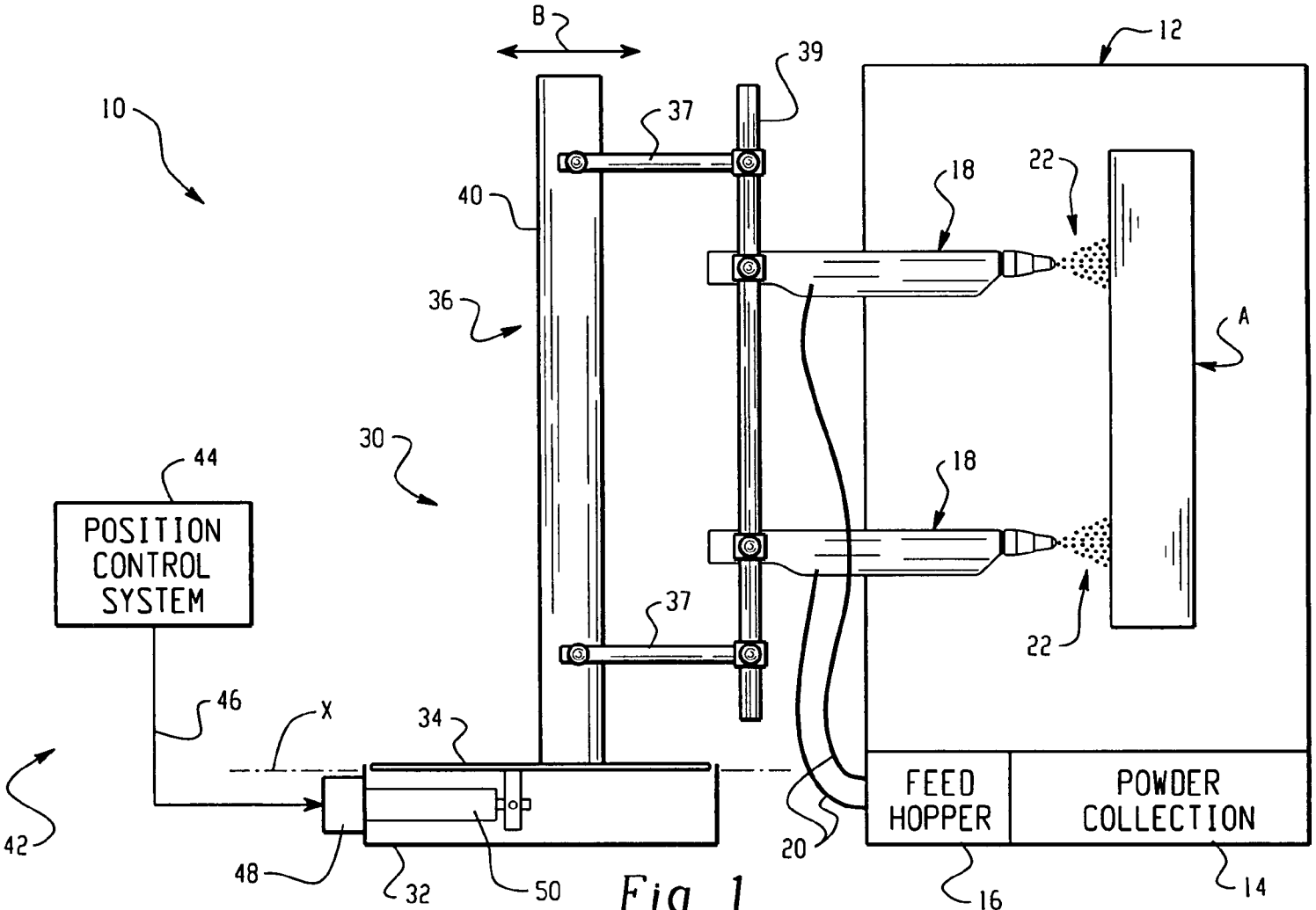
Fig. 1 PRIOR ART
FIGS. 1 and 2 illustrate in side, back elevations and perspective views respectively a typical prior art powder spray system utilizing a gun mover.
Figure 2:
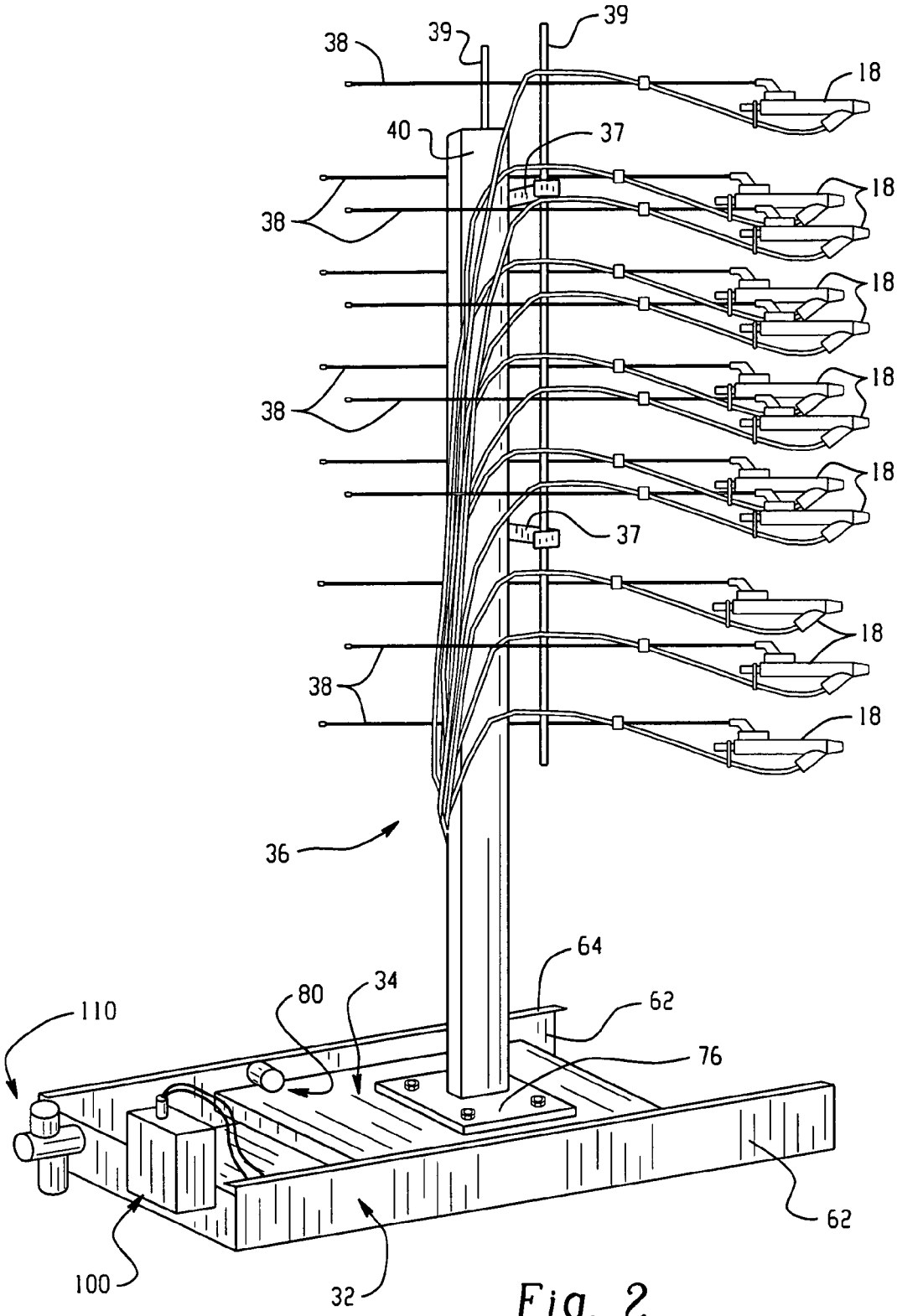
Fig. 2 PRIOR ART
Figure 5:
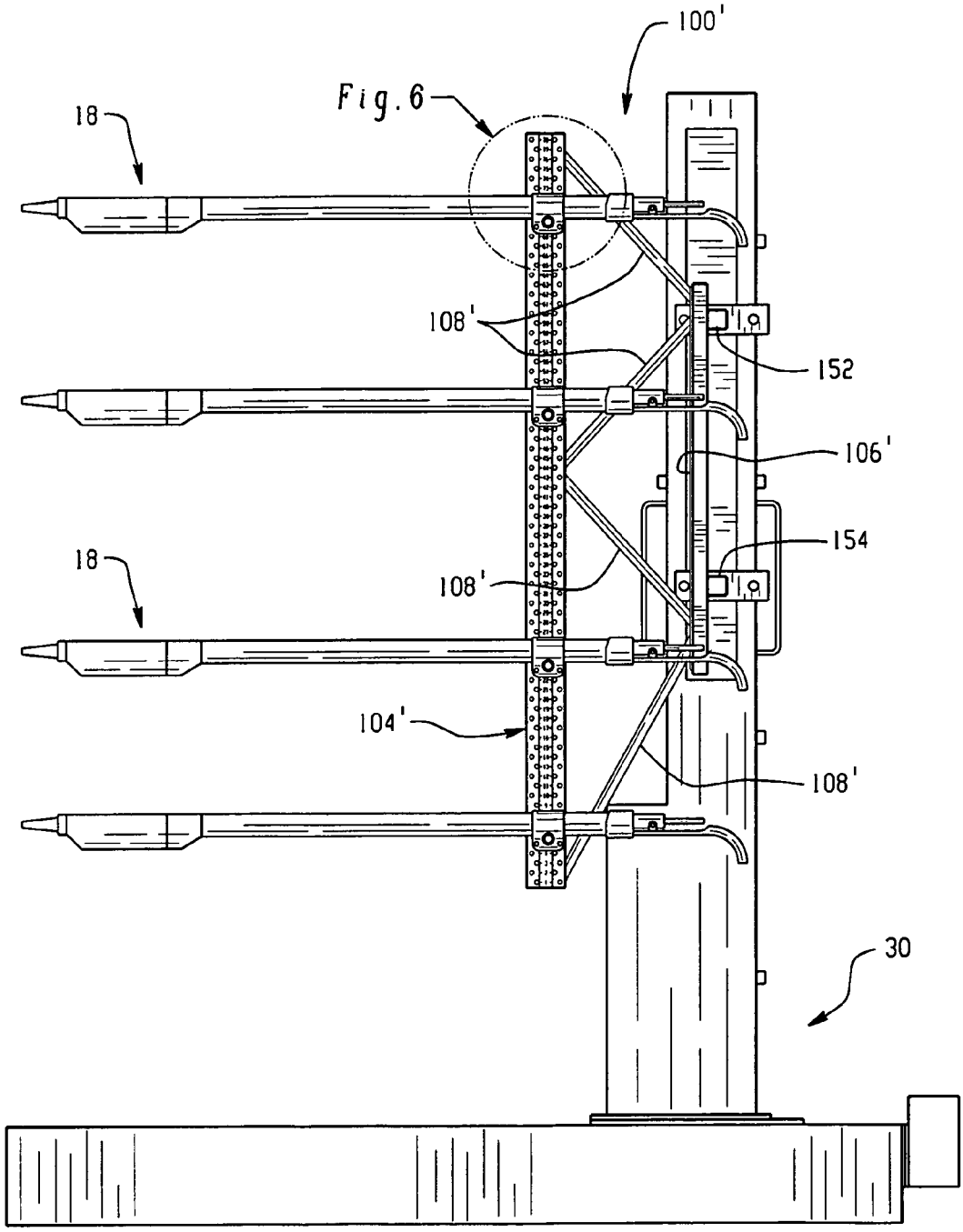
FIG. 5 illustrates in elevation another embodiment of a gun mounting bracket.
Figure 7:
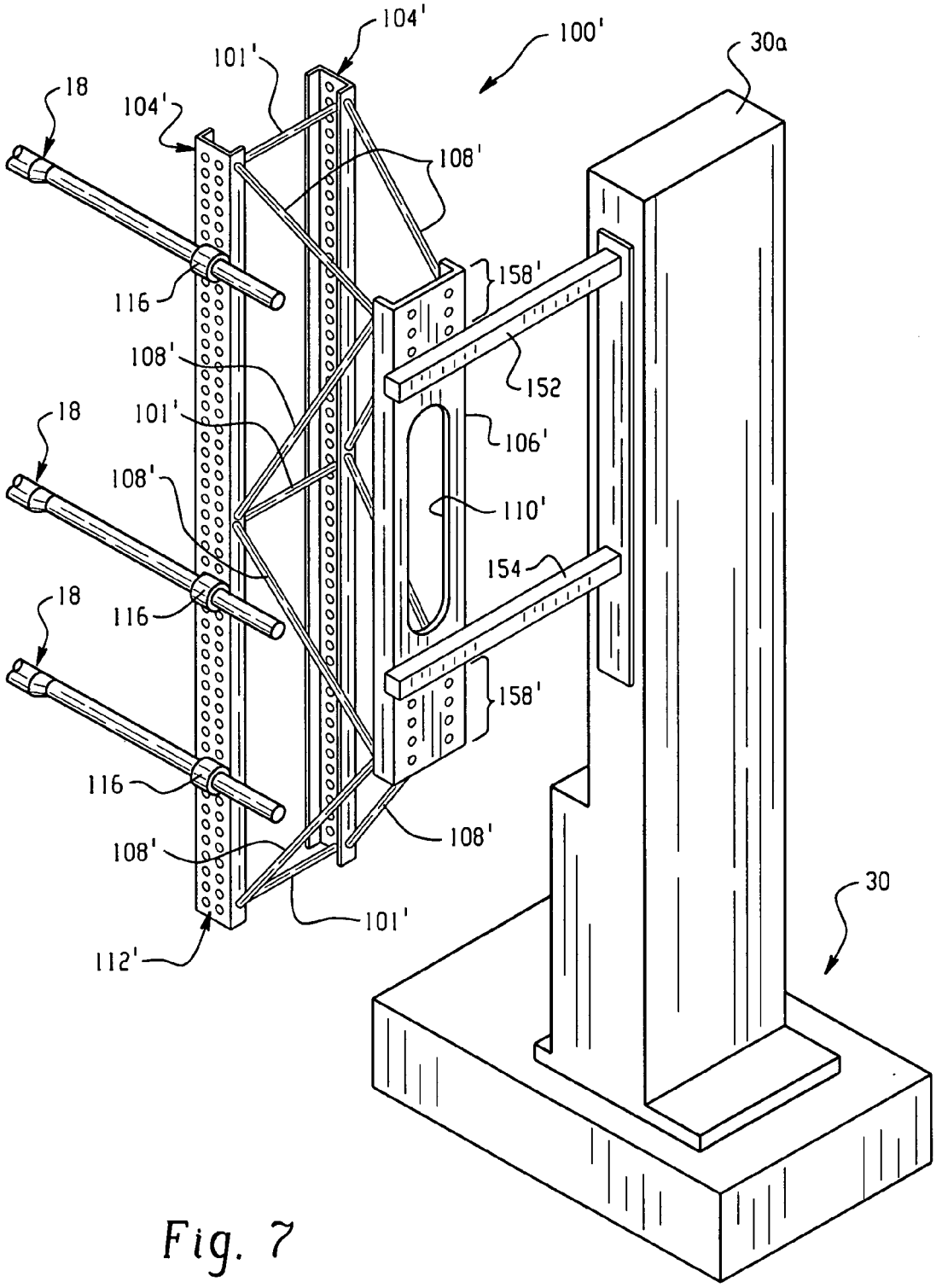
FIG. 7 is a perspective view of the embodiment illustrated in FIG. 5.

FIGS. 5 and 7 illustrate another embodiment of the invention in which the mounting bracket is formed by a series of interconnected or joined sections of tubular stock such as steel or aluminum. All other elements may be the same as described hereinbefore with the embodiment of FIG. 3. In FIGS. 5 and 7 the reference numerals include primes(') to indicate elements that correspond to elements illustrated in the embodiment of FIG. 3. The truss-like mounting bracket 100' is preferably an integral structure having tubular truss supports 108' welded or otherwise secured at one end to the back mounting plate 106' and at the other end to the two vertically extending gun mount flanges 104'. The tubular frame elements 108' may flare outwardly in a manner similar to the truss-like bodies 102 in the embodiment of FIG. 1.

The highly stable and repeatable gun mounting arrangement realized through the use of the mounting bracket 100 and position indicating device 120 can help facilitate reliable powder blow off of the spray gun 18 exterior surfaces during a cleaning or color change operation. This is because typically the gun mounting position is selected as a separate step from positioning a gun blow off air nozzle. In typical prior art arrangements, the blow off nozzles are relatively fixed in position or not readily adjustable. Therefore, if a gun could not be accurately positioned, it might not be adequately cleaned by the air nozzles. In contrast, the present invention facilitates such cleaning operations by providing a mounting arrangement that reliably and repeatedly facilitates positioning of the guns 18 on the mounting bracket 100.

Figure 8:
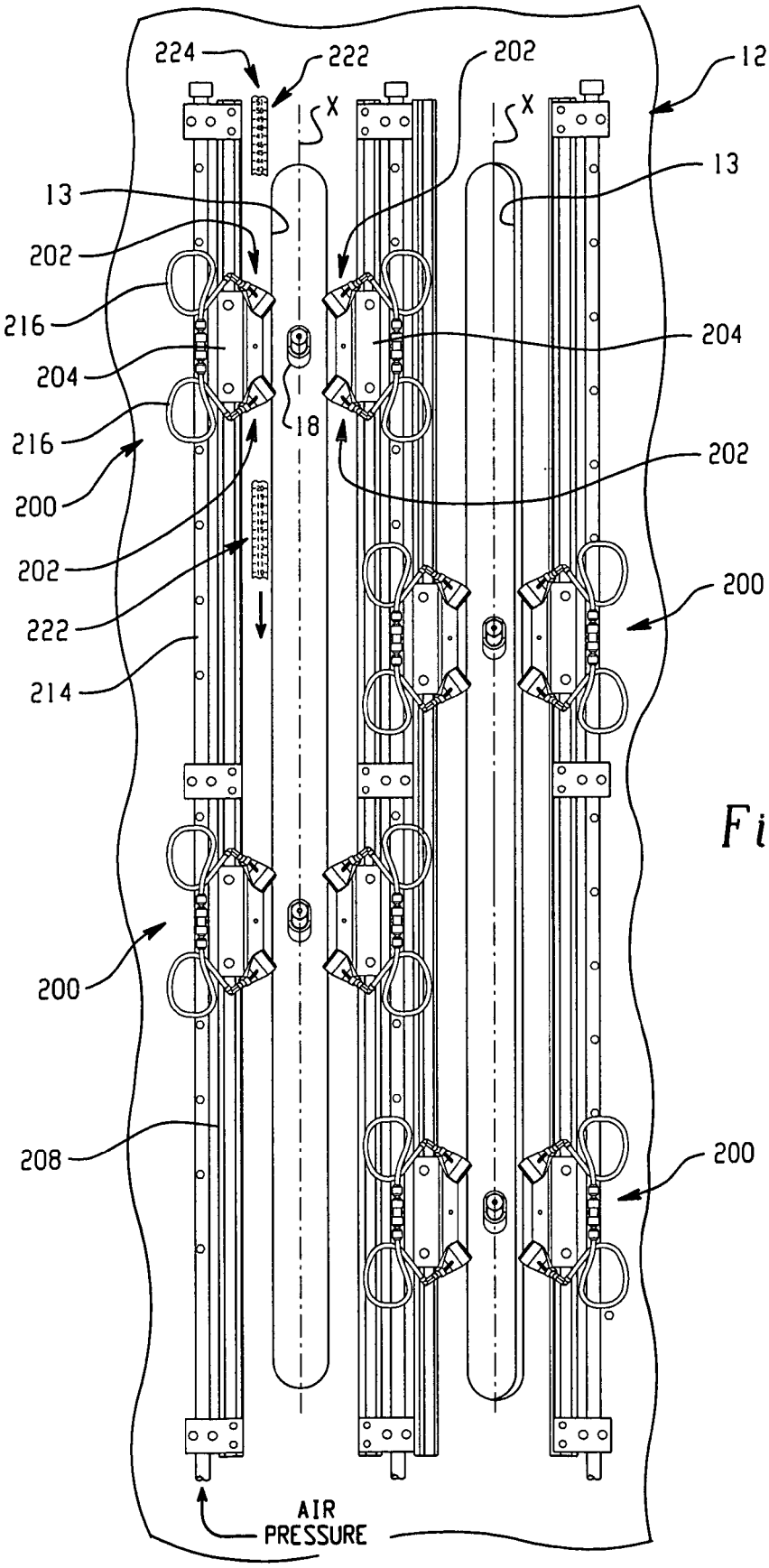
FIG. 8 is an elevation of a gun blow off arrangement for powder spray guns shown installed with a powder spray booth.
Figure 9:
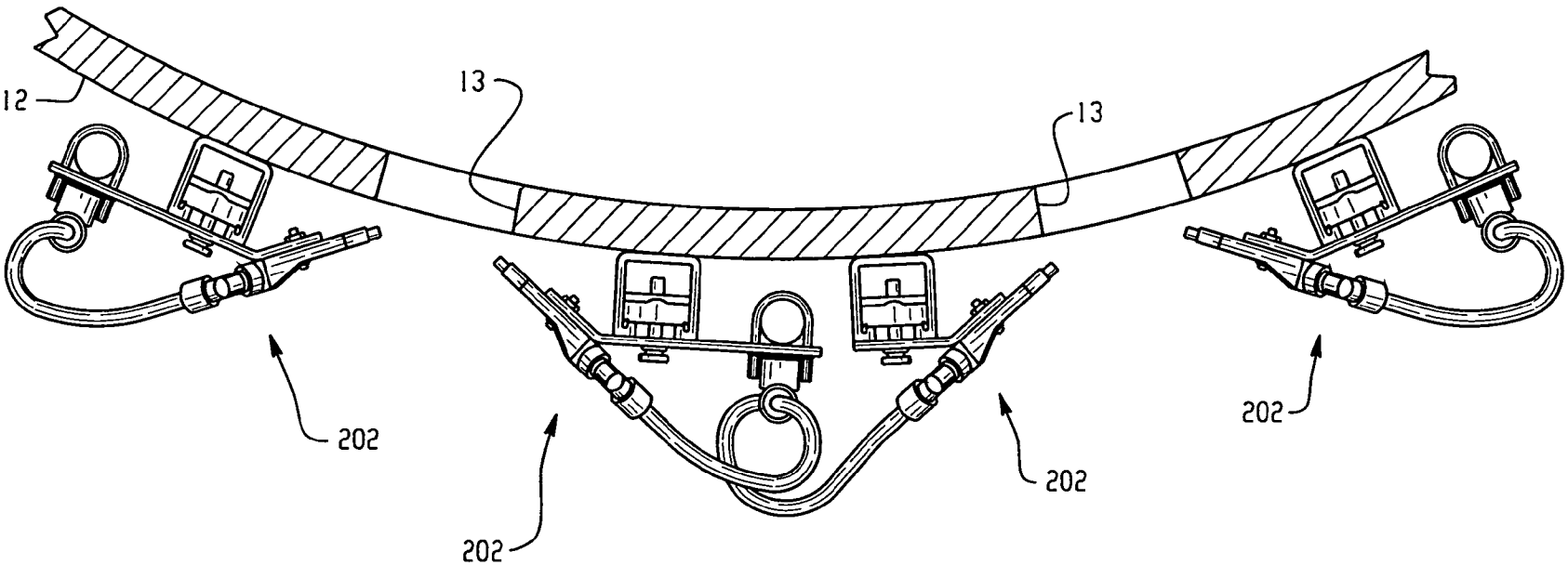
FIG. 9 is a top view of the illustration of FIG. 8.
Figure 10:
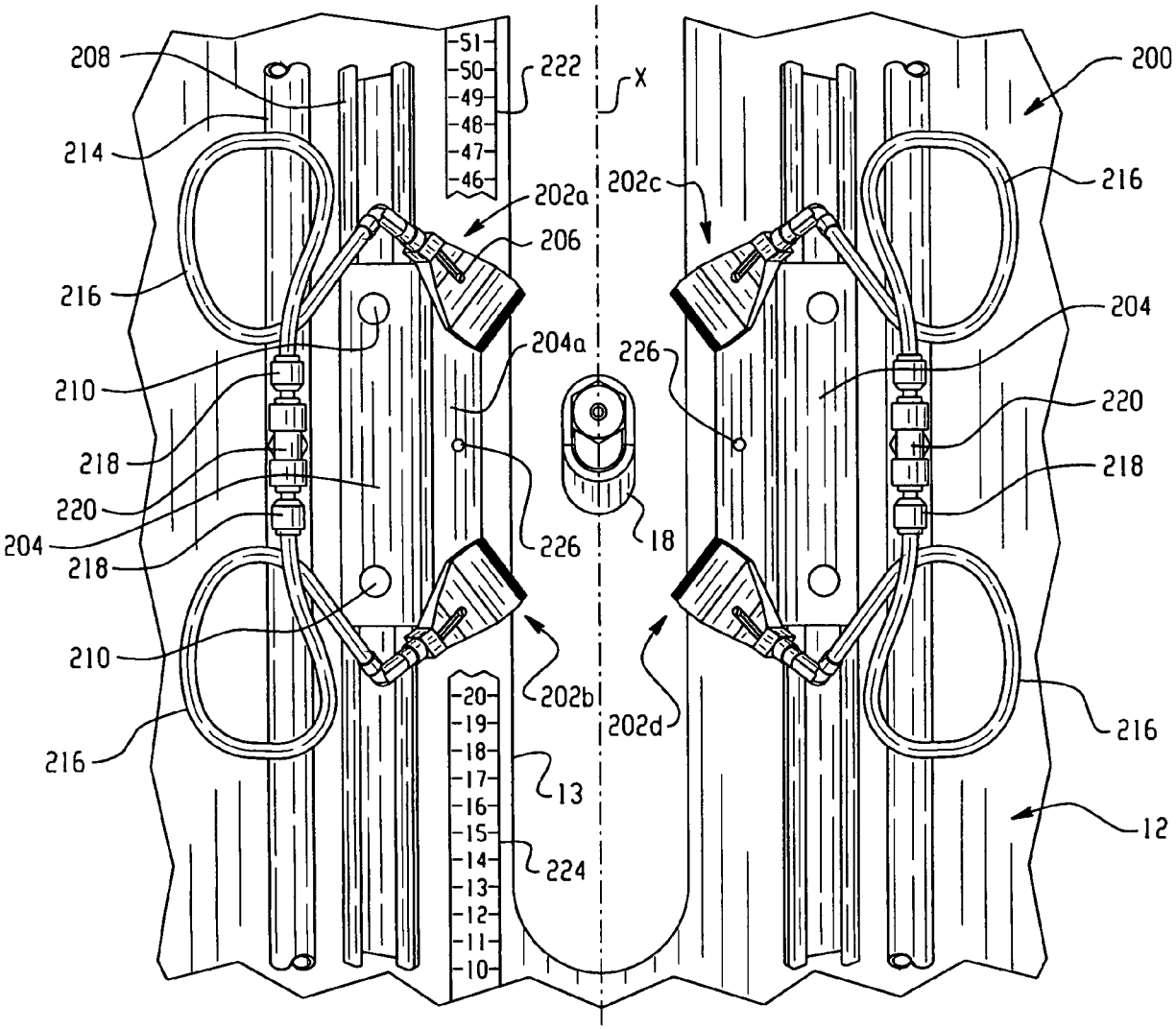
FIGS. 10 and 11 are enlarged views of a portion of FIGS. 8 and 9 respectively.
Figure 11:
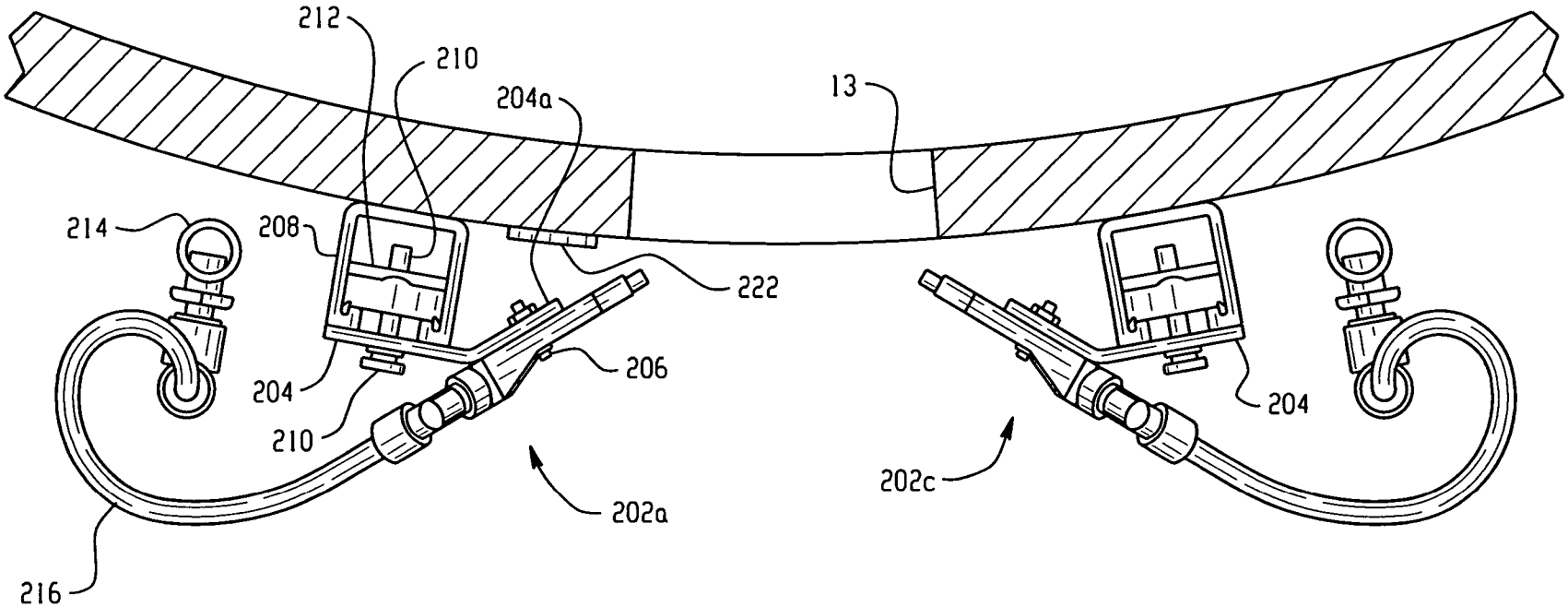

FIGS. 8–11 illustrate a spray gun blow off mounting arrangement in accordance with another aspect of the invention (note that in FIGS. 9 and 11 the spray gun 18 is omitted for clarity and ease of illustration). This blow off mounting arrangement may be used in combination with the spray gun mounting arrangement of the present invention to provide improved gun cleaning operations and hence faster color change operations. For clarity, the gun mounting arrangement is omitted from FIGS. 8–11 but may be realized in the form described herein or any other suitable mounting arrangement.

FIGS. 8 and 9 illustrate a plurality of gun blow off arrangements 200, only one of which will be described herein as the others may be the same in form and function.

Each gun blow off mounting arrangement 200 includes four air nozzles 202 positioned as required to direct pressurized air at an exterior surface of the associated spray gun 18. Although four air nozzles are preferred, other numbers of nozzles may be used as required. In the preferred embodiment, the air nozzles 202 are mounted in associated pairs with each associated pair being installed on a respective side of the spray gun 18 relative to a vertical axis X that is generally parallel to a vertical centerline of the gun opening 13 in the spray booth 12.

With reference also to FIGS. 10 and 11, each associated pair of nozzles 202 (for example, nozzles 202*a* and 202*b* or nozzles 202*c* and 202*d* in FIG. 10) are mounted on a nozzle mounting bracket 204. The nozzle mounting bracket 204 includes an angled flange 204*a* that carries the nozzles 202. Each nozzle 202 is preferably pivotally attached to the mounting bracket flange 204*a* by a screw and nut arrangement 206. The optional pivoted attachment is useful for adjusting the angle of the nozzle 202 towards the spray gun 18.

The nozzle mounting bracket 204 is mounted on a support channel 208. The channel 208 permits sliding movement of the bracket 204 along a portion of the channel 208 to permit vertical adjustment of the position of the air nozzles 202 relative to the gun 18. Once the nozzle position has been selected, the bracket 204 is releaseably joined to the channel 208 using thumb screws 210. The thumb screws 210 cooperate with a clamping member 212 such as a channel nut that is disposed inside the channel 208. When the thumb screws 210 are tightened, the clamping member 212 is pulled up against the channel legs to clamp the flange 204 against the channel 208. Simply loosening the thumb screws 210 allows the flange 204 to be moved to another position along the channel 208. In the preferred embodiment the bracket 204 thus allows two nozzles 202 at a time to be moved.

A pressurized air manifold 214 extends vertically and generally parallel to the channel 208. The air manifold 214 may be attached, for example, to the channel 208 or as another example, spray booth 12 wall. Pressurized air is supplied to the manifold 214 by any suitable fitting (not shown). The channel 208 likewise may be attached to the spray booth wall, for example.

Each air nozzle 202 is coupled to the air manifold 214 via a flexible air hose 216 and a suitable fitting or connector 218. Each air hose 216 is connected at one end to its respective air nozzle and at an opposite end to a "t" fitting 220 that is in fluid communication with the air manifold 214. Other suitable connection arrangements may alternatively be used as required to couple each nozzle 202 to the air manifold 214. The length of the flexible hoses 216 may be selected based on the total maximum length of adjustable movement of the bracket 204 along the channel 208.

An air nozzle position indicator device 222 may also be provided. In this example, the device 222 is realized in the form of an adhesive label or other suitable marking on the spray booth wall. Alternatively, the position indicating device 222 may be positioned at any conveniently viewable location and may take many other different forms as will be apparent to those skilled in the art. The position indicating device 222 may include suitable indicia 224 thereon, such as height markings in inches, although other indicia may be used. The indicia provide a reference datum for recording or selecting the vertical position of the bracket 204 and hence the air nozzles 202. The indicia 224 may correspond or otherwise have a predetermined relationship to the indicia 122 on the gun mounting flanges 104 (FIG. 6). Use of the position indicating device 222 permits accurate and repeatable positioning of the air nozzles 202 during set-up to assure that the nozzles 202 are properly positioned relative to the spray gun 18 to optimize powder blow off. A separate position indicating device 222 is in this exemplary embodiment used for each channel/bracket arrangement, although alternatively a single indicator 22 could be used.

The bracket flange 204*a* may include a viewing and alignment indicator 226 that can be used as a reference marker for recording or aligning with the position indicia 224 that corresponds to the vertical position of the bracket 204. Alternatively, the bracket 204 may be made of a clear material through which the device 222 may be viewed even if positioned behind the bracket 204. Although not shown in the drawings, preferably each blow off assembly 200 may have an associated position indicating device 222.

When used together, the gun position indicating device 120 and the air nozzle position indicating device 222 assure that the nozzles 202 are properly positioned relative to their respective spray gun 18 for cleaning the gun 18. The rigid gun mounting bracket 100 (or 100') and the nozzle mounting arrangement also assure repeatable support and position of the spray guns 18 relative to the nozzles 202.

The invention has been described with reference to the preferred embodiment. Modifications and alterations will occur to others upon a reading and understanding of this specification. It is intended to include all such modifications and alterations insofar as they come within the scope of the appended claims or the equivalents thereof.

Having thus described the invention, it is claimed:

1. A powder spray application system, comprising:

a powder spray gun;

a powder spray booth having a gun opening for receiving the powder spray gun;

a pair of air nozzles that direct pressurized air at an outside surface of the powder spray gun to remove powder from the powder spray gun and direct the removed powder into the powder spray booth; and a pair of nozzle mounting brackets mounted to a wall of the powder spray booth so that the position of said brackets can be moved along at least a part of the length of the gun opening, relative to the position of the spray gun;

one of said air nozzles being mounted to each of said mounting brackets.

2. The apparatus of claim 1 wherein said brackets are adjustable vertically relative to a selectable vertical position of the spray gun.

3. The apparatus of claim 1 comprising at least two sets of said pair of air nozzles with each said pair disposed on a respective movable nozzle mounting bracket and with each said respective movable mounting bracket arranged on a respective side of the gun opening.

4. The apparatus of claim 1 comprising an air manifold and a respective air hose that connects each said air nozzle to said manifold.

5. The apparatus of claim 4 wherein said air hoses are coupled to a single port in said air manifold.

6. The apparatus of claim 4 wherein said air manifold is installed on an outside wall of the spray booth adjacent the gun opening in the spray booth through which the spray gun extends into the spray booth interior.

7. The apparatus of claim 1 comprising a vertically arranged bracket support member installed on an outside surface of the spray booth; at least one of said nozzle mounting brackets being adjustably installed on said support member.

8. The apparatus of claim 1 comprising a position indicating device proximate at least one of said mounting brackets and said air nozzles to indicate vertical position of said air nozzles.

9. The apparatus of claim 8 wherein said position indicating device comprises a numerically indexed scale.

10. The apparatus of claim 1 wherein said brackets are angled to support said air nozzles at an orientation that directs pressurized air at the spray gun surface and into the spray boot.

11. Powder blow-off apparatus for powder spray guns used in a powder spray application system, comprising:

at least one air nozzle that directs pressurized air at an outside surface of a powder spray gun to remove powder from the powder spray gun end direct the removed powder into a powder spray booth, wherein the powder spray gun is received through a gun opening on the powder spray boot; and a nozzle mounting bracket arranged with the spray booth so that the position of said bracket can be slideably adjusted along a part of the length of the gun opening, relative to the position of the spray gun, wherein the at least one air nozzle is pivotally attached to the nozzle mounting bracket.

12. The apparatus of claim 11 wherein said bracket is installed on a vertically extending channel member attached to the spray booth; and further comprising a releasable clamping device that holds said bracket and channel member together; said bracket being adjustable in position along a length of said channel member.

13. A powder spray application system, comprising:

a powder spray gun;

a powder spray booth having a gun opening for receiving the powder spray gun;

a pair of nozzle carriages mounted to a wall of the spray booth on opposite sides of the gun opening; each carriage being movable along at least a part of the length of the gun opening relative to the position of the spray gun; and two pair of air nozzles that direct pressurized air at an outside surface of the powder spray gun to remove powder from the powder spray gun and direct the removed powder into the powder spray booth; each pair of air nozzles disposed on a respective nozzle carriage.

14. The powder spray application system of claim 13 wherein each pair of air nozzles are pivotably mounted to each respective nozzle carriage.

* * * * *

UNITED STATES PATENT AND TRADEMARK OFFICE

CERTIFICATE OF CORRECTION

PATENT NO. : 7,172,138 B2
APPLICATION NO. : 10/470453
DATED : February 6, 2007
INVENTOR(S) : Brian D. Mather et al.

It is certified that error appears in the above-identified patent and that said Letters Patent is hereby corrected as shown below:

Claim 11, Col. 9, line 22, please change the word “end” to read --and--.

Claim 11, Col. 9, line 25, please change the word “boot” to read --booth--.

Signed and Sealed this

Twentieth Day of November, 2007

JON W. DUDAS
*Director of the United States Patent and Trademark Office*